United States Patent [19]

Nuber

[11] 4,026,126

[45] May 31, 1977

[54] METHOD OF KNITTING KNIT PLUSH FABRIC HAVING A NAP, OR PILE LOOPS

[76] Inventor: Otto Nuber, Fouquet Siedlung 53, 7407 Rottenburg, Germany

[22] Filed: Dec. 4, 1975

[21] Appl. No.: 637,819

[30] Foreign Application Priority Data

Dec. 7, 1974 Germany ..... 2458009
Aug. 7, 1975 Germany ..... 2535197

[52] U.S. Cl. ..... 66/9 R; 66/121; 66/92

[51] Int. Cl.[2] ..... D04B 9/12

[58] Field of Search ..... 66/9 R, 121, 194, 1 A, 66/92

[56] References Cited

UNITED STATES PATENTS

| | | | |
|---|---|---|---|
| 1,884,090 | 10/1932 | Mills | 66/121 X |
| 1,997,530 | 4/1935 | Mills | 66/121 |
| 2,056,686 | 10/1936 | Mills | 66/9 R |
| 3,874,197 | 4/1975 | Plath | 66/92 X |

FOREIGN PATENTS OR APPLICATIONS

| | | | |
|---|---|---|---|
| 330,041 | 6/1930 | United Kingdom | 66/121 |
| 12,343 | 6/1896 | United Kingdom | 66/121 |

*Primary Examiner*—Mervin Stein
*Assistant Examiner*—Andrew M. Falik
*Attorney, Agent, or Firm*—Flynn & Frishauf

[57] ABSTRACT

An inlay or plaiting yarn is passed through knit stitches of a plain knitted fabric, the plaiting yarn is wrapped around the side portions of the knit stitches of the base fabric by a needle having a main latch and an auxiliary, angled latch, is knocked off over the tip end of the needle while the stitch of the main fabric is caught in the hook thereof, the plaiting yarn being pulled down by sinkers to pull the plaiting yarn tight about the lateral sides of the base knit fabric to form loop piles, and cut, if desired, to form cut pile fabric.

3 Claims, 30 Drawing Figures

METHOD OF KNITTING KNIT PLUSH FABRIC HAVING A NAP, OR PILE LOOPS

The present invention relates to knit plush fabric in which an inlay plush yarn or thread is knitted into and interlocked with a base knitted fabric, and specifically to a mehtod of making such a fabric.

Various types of plush goods have been described in the literature; for example German Pat. Nos. 1,153,482 and 1,585,051 disclose plush goods having high nap, a pile both cut and looped, in which the plush yarn forms two-thread loops with the stitches of the base material, so that the plush yarn is securely fixed in the base material. Further, German Pat. No. 1,943,345 describes plush fabric in which the plush yarn is worked into the base knit fabric between the knock-over loops and the loops, or stitches formed by the needles themselves, similarly to lined material, and is later on securely connected to the base goods by means of adhesives.

Working a plush yarn into the loops of the base material in such a manner that it forms double-thread loops or stitches therewith, makes the resulting material very heavy if the plush yarn material is comparatively thick, and thus substantially increases the cost of the fabric. The other type of plush goods, in which the plush yarns are between the needle stitches and the knock over stitches requires adhesion in order to provide for secure connection between the plush thread or yarn and the base fabric, thus limiting the use of the fabric while additionally causing costs to be incurred by the adhesion step, which also further requires an additional step in the production process.

All the types of plush goods previously referred to have as a common feature that the plush yarn is attached to the base goods at an inclination. As a result, the nap of the plush is not vertically projecting from the general or main plane of the base fabric.

It is an object of the present inventon to provide plush goods, a method for its manufacture and apparatus and apparatus components which results in plush fabric in which the plush yarn is securely locked to the base goods while projecting essentially vertically therefrom so that the nap stands upright, without requiring interknitting an excessive amount of plush thread or yarn material in the base goods, and which is universally useful for plush goods without requirement of additional special treatment steps or subsequent processing.

Subject matter of the present invention: Briefly, the plush inlay yarn is passed through the knit stitches or loops of the base fabric in the form of loops wrapped around the side portions of the knit stitches of the base fabric, knocked off over the knit stitches and pulled tight about the knit stitches such that the plaiting or inlay plush thread or yarn is knitted into the loops or stitches of the base fabric like being knotted thereto, the plush yarn having upwardly projecting side portions.

The plush fabric provides for true knotting of the plush loops or stitches with the base fabric with a similar connection as that found in hand knotted carpets. The base fabric, preferably, is single layer plain knit fabric; for certain specific desired applications, different stitch or loop formations can be used, however.

The side portions of the blush inlay yarn can be cut open at the center point between the apices of the loops; if 50, the appearance will be similar to a Wilton carpet. The fabric, therefore, can be selectively formed with a looped, or with a cut nap, as desired. The plush inlay yarn may be interknitted with the base fabric only in selected stitches thereof, in accordance with certain patterns. Usually, however, the plush yarn will be interknitted with all stitches or loops of the base fabric. The base fabric may be made of yarn which, essentially, maintains its dimensions, or may be made of elastic yarn.

The fabric in accordance with the present invention is versatile in application; it may be used, for example, similar to terrycloth, that is, for toweling or the like; it may be used as upolstery fabric, for carpets (in which the inlay yarn is not adhered to the base) as well as for articles of clothing. Ordinarily, the base fabric will be a single yarn fabric, to which the inlay plush yarn is knotted. At any one knitting feed, therefore, only a single yarn thread is being worked on, so that wide selection is possible regarding the thickness of the yarn, its quality, and its composition. The plush inlay yarn and the base fabric yarn may have substantial differences.

The method of making the fabric, in accordance with the present invention, includes first knitting at least one base yarn on a needle row (dial or cylinder), then pushing the base stitches back on the shank of the needles and introducing the plush inlay yarn on the back of the shank of the needles, and forming plush inlay loops therewith; thereafter, the plush inlay yarn loops are pulled through the stitches of the base yarn as the base yarn stitch loops slide back on the shanks of the needle into the hook of the neddle; thereafter, the plush inlay yarn loops, now in stitch form, are knocked off the head of the needle and are then pulled tight.

The plush fabric is made, in accordance with another feature of the invention, by a circular knitting machine in which one of the rows of knitting elements, for example the dial, has plush knitting needles therein which are so arranged that a pivotable angled latch is located thereon, which latch can be locked in at least on latching position. The other knitting elements located in the other row of the machine, for example in the cylinder are sinker lamellae located in the guide slots thereof. The angled auxiliary latch on the plush knitting needles may be locked in position, for example, by a steel spring in order to prevent random pivoting thereof.

The sinker lamellae located in the other row or needle bed of the machine — for example in the cylinder — permit extending the loop ends of the inlay plush yarn, thus securely knotting the plush yarn into the stitches of the base fabric. Preferably, the sinkers are formed with hook ends, the hooks facing the needles. In such an arrangement, the plush yarn unhooks itself from the hooked ends upon release of the plush yarn therefrom.

In fabric made by machines with coarse cuts, and to use plush yarn of thicker gauge, the plush knitting needles may be formed of two elements, one being a standard latch needle and the other a second element located in the upper side of the blade, or shank of the latch needle and carrying the angled latch element, as well as the locking spring therefore. Both the needle, as well as the auxiliary element are slidable, and can be controlled by a common cam race of the cam system of the knitting machine.

If the nap is to be cut, then the sinker lamellae are preferably constructed of two parallel located thin sheet lamellae, made, for example, of thin sheet metal between which a cutter lamella is located having a sharpe cutting edge. The cutter lamella is separately controllable to slide relative to the two associated sinker lamellae in the direction of the end hook on the sinkers to cut the connecting loop between stitches of the plush yarn.

The invention will be described by way of example with reference to the accompanying drawings, wherein FIG. 1 shows the plush fabric from the plush side, in schematic representation;

Figure 3:
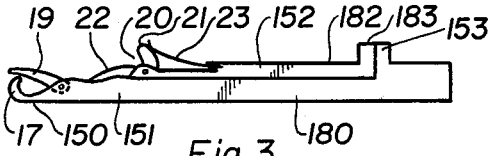
FIG. 3 is a side view of a two-element needle.
Figure 4:
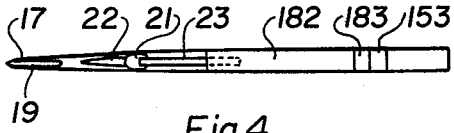
FIG. 4 is a top view of the needle of FIG. 3.
Figure 2:
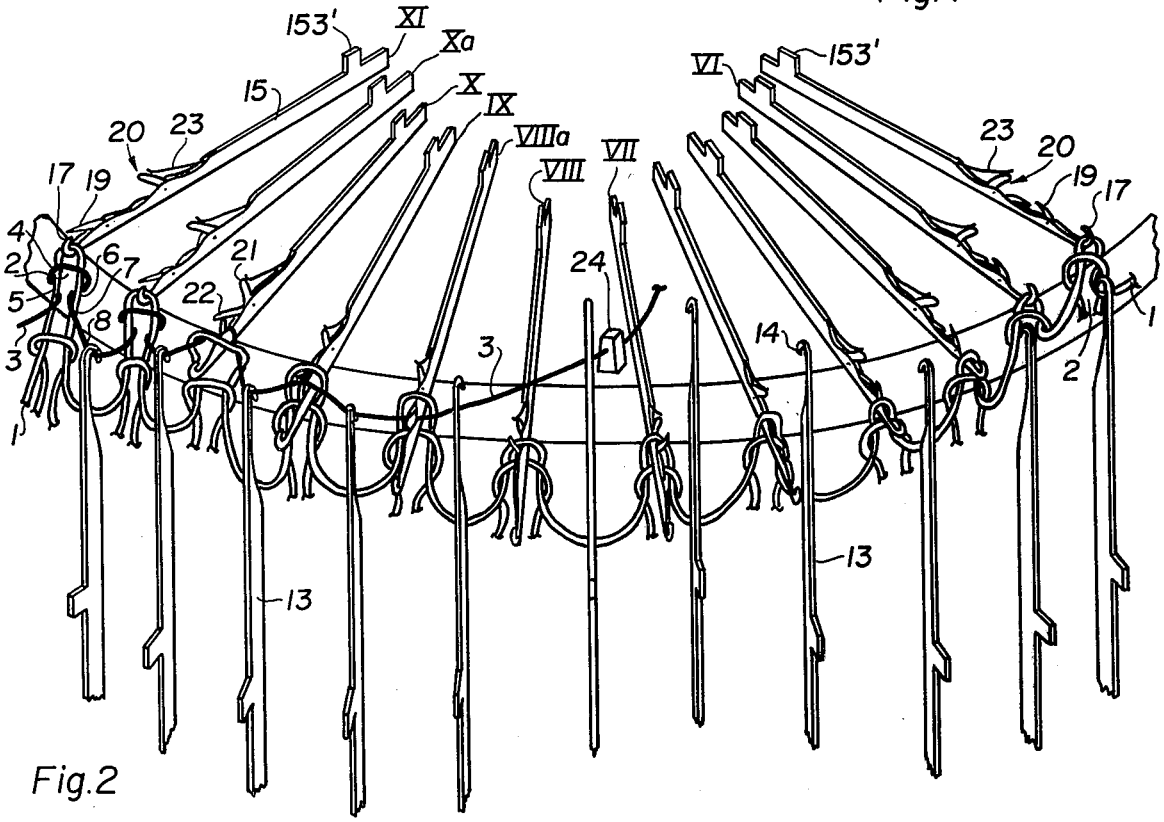
FIG. 2 is a perspective view of sequential steps in knitting the base fabric, as well as introduction of the plush yarn and interknitting as well as interlocking of the plush yarn on a circular knitting machine with rotating dial and cylinder.
Figure 5A:
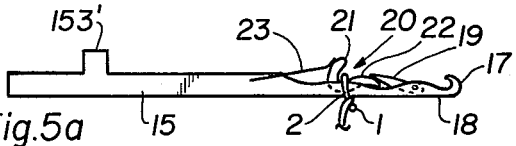
Figure 5B:
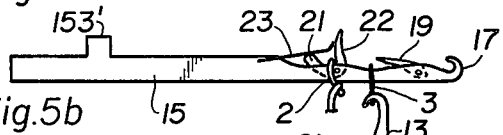
Figure 5C:
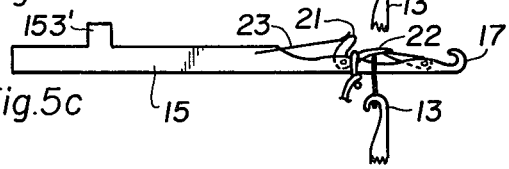
Figure 5D:
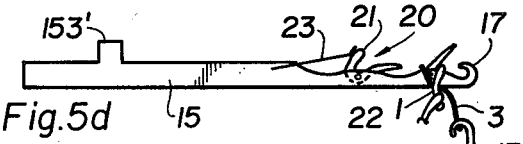
Figure 5E:
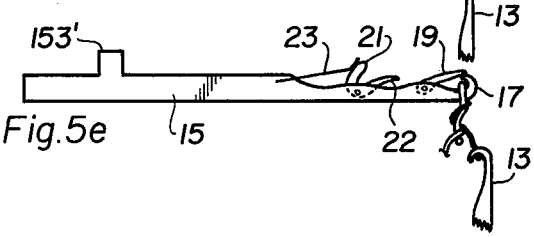
Figure 17:
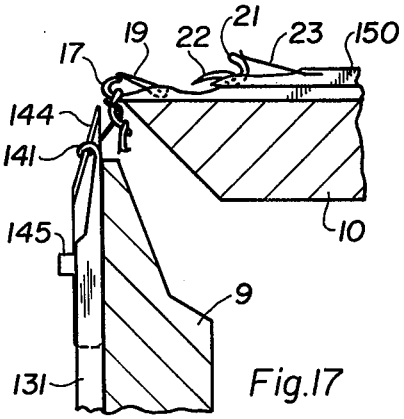
Figure 20:
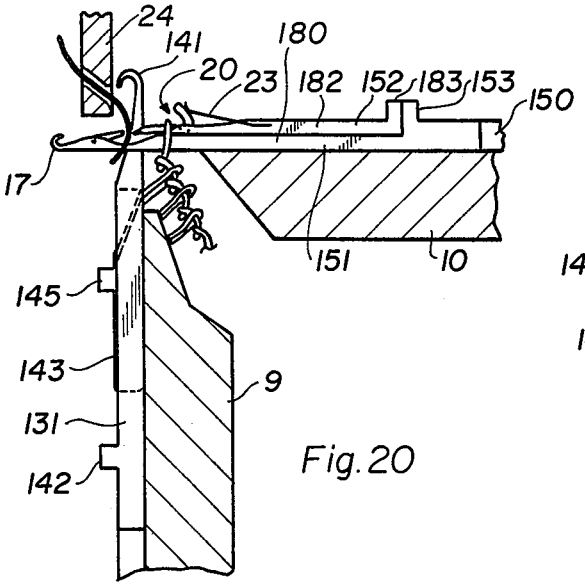
Figure 19:
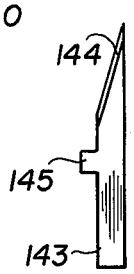
Figure 18A:
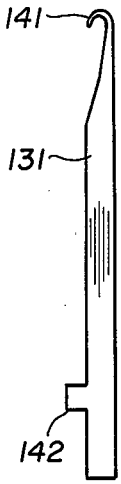
Figure 18B:
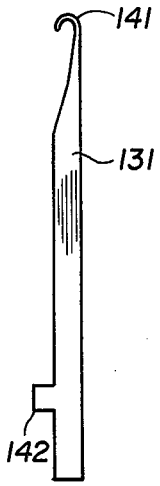
Figure 21:
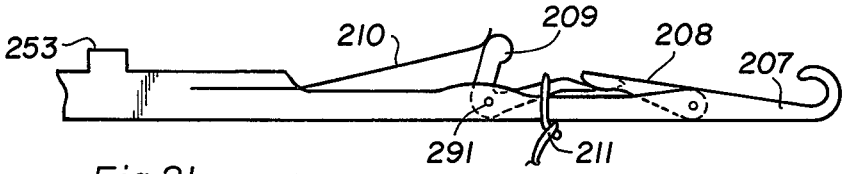
Figure 22:
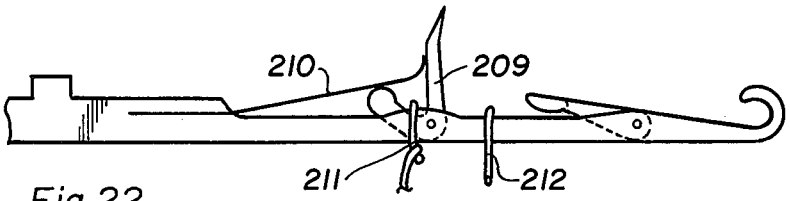
Figure 23:
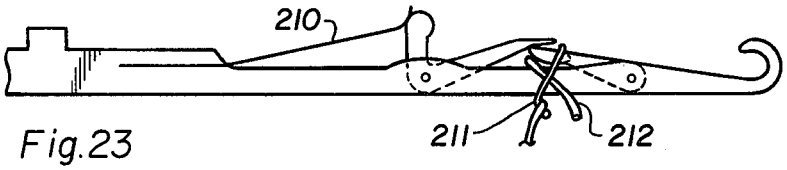
Figure 24:
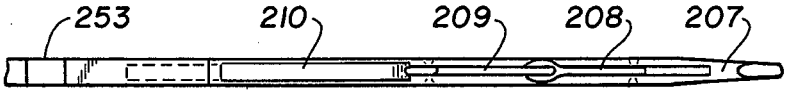
Figure 25:
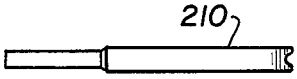

FIG. 5, in views *a*-to-*e* illustrates a single-element needle of the machine of FIG. 2 in sequential operating steps to illustrate the interknitting and knotting of the inlay plush yarn with a stitch of the base fabric;

FIGS. 6 to 11 illustrate a knitting needle and the associated sinker lamellae of the machine of FIG. 2, but in side view, illustrating sequential steps in knitting the knotted interconnection between the plush yarn and the stitch of the base fabric, when making loop-pile plush fabric;

FIGS. 12 to 17 are schematic views, similar to FIGS. 6 to 11 in which the sinker lamellae are three-part elements including a cutting lamella, to make cutpile plush fabric;

FIGS. 18, in views *a* and *b* illustrates two sinker lamellae of the sinkers used in FIGS. 12 to 17;

FIG. 19 is a side view of a cutting lamella used in the machine of FIGS. 12 to 17;

FIG. 20 is a schematic side view of a two-element needle corresponding to the needles of FIGS. 3 and 4, cooperating with a multi-element sinker shown in FIGS. 18 and 19 to illustrate production of cut-pile plush fabric;

FIG. 21 is a side view, to an enlarged scale, of a latch needle, used in the machine of FIG. 2, in the first operating position;

FIGS. 22 and 23 are side views similar to FIG. 21 in other working positions of the needle;

FIG. 24 is a top view of the needle in the position of FIG. 23;

FIG. 25 is a detailed view of the spring element of the needle and

Figure 26:
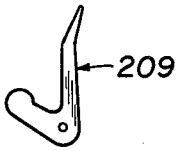

FIG. 26 is a detailed view of the angle latch of the needle of FIGS. 21 – 24.

The fabric (FIG. 1) shows a knitted base yarn 1 in which the stitches are arranged in a plane jersey knitted fabric. The base fabric determines the density and strength of the ultimate plush to be knitted.

Figure 1:
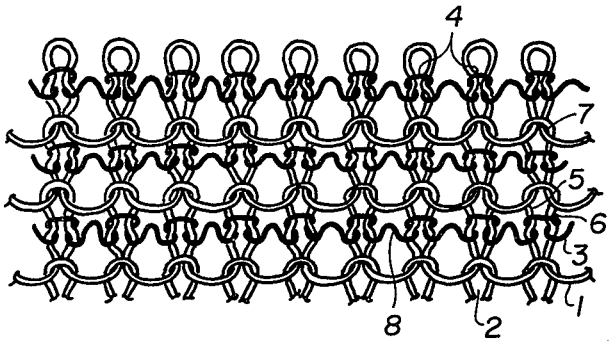

The stitches or loops 2 of the base fabric have a plush inlay yarn 3 pulled therethrough in form of a loop 4. As seen in FIG. 1 the two side portions 5, 6 of the base stitch 2 have the yarn looped there-about, knocked off over the end loop47 p portion 7 of the base loop 2 and then pulled tight. the plush yarn 3 then will have upstanding pile ends 8 which are locked into the stitch 2 of the base fabric similar to a knot connection. The lateral portions of the plush fabric pile ends 8 can be cut intermediate the respective stitches thereof, resulting in a cut pile, or cut nap plush fabric.

The density of the plush fabric can be determined by the cut of the base fabric, the number of stitches in the base fabric, as well as by the nature of interknitting of the inlay plush yarn 3. FIG. 1 illustrates the plush yarn knitted into each one of the stitches 2 of the base fabric. The arrangement may be different, however, for example, by interknitting the plush yarn 3, in accordance with a predetermined pattern, only in selected ones of the stitches 2 of the base fabric, for example in every other one, in two adjacent ones skipping one, and the like. The base fabric may be a single thread fabric made of normal yarn; for some applications the yarn 1 of the base fabric may be elastic material. Rather than knitting a plain jersey fabric, other types of stitches can be used (for example purl stitches); the base fabric may be of a single color or multi-colored, as determined by patterning control elements.

The circular knitting to make the fabric of FIG. 1 is schematically, and in highly perspective view illustrated in FIG. 2, from which all those elements which are customary in circular knitting machines have been omitted for ease of illustration. For example, the cam races of the control cams for the needles have been omitted, the needles being shown in their respective positions as controlled by the cams and cam lock mechanisms of the dial, and cylinder, respectively. The needle beds, that is, the dial and cylinder, are formed with suitable guide slots in which knitting elements — needles in the dials and sinker lamellae in the cylinder — are inserted. The cut is highly exaggerated for clarity of illustration.

FIGS. 6 to 11 are fragmentary views showing the end portions of cylinder 9 and dial 10, which carry the needle bed, as well known, and in which the knitting elements are longitudinally slidable. The sinkers 13 are in the form of lamellae, that is, thin metal strips. In the embodiment of FIG. 2 and as illustrated in FIGS. 6 to 12 these are single-element units which have a hook 14 facing the dial 10.

The guide slots of the dial 10 have needles 15 located therein. As seen in FIG. 5, in sequentially arranged views *a* to *e*, and as more specifically shown in FIGS. 21 to 26, the needles are single, unitary elements which have two latch hooks. As shown in FIGS. 3 and 4, the needles are compound elements in which a second latch hook is arranged on a separate shank. The needles 15, or 150, (FIGS. 3, 4) are projected by engagement of a butt 153′ FIG. 2, or 153, 183, (FIG. 3 and 4), respectively, in the cam race of the usual dial cam structure (not shown), which is fixed with respect to the base of the machine, and with respect to which the needles are moved. Similarly, the sinker lamellae 13 are controlled by the cam race a stationary cylinder cam structure, not shown, and as well known in connection with the projection of cylinder needles in circular knitting machines.

The needles 15 as shown in FIGS. 2 and 5, have a hook 17 and a latch 19 pivoted on the shank 18 of the needle, as standard and well known. In accordance with the feature of the invention, a second latch element 20, which is angular in shape is pivoted in a suitable groove of the needle shank 18, similar to the pivoting arrangement of latch 19. The second, or auxiliary latch 20 has two arms 21, 22 which are angled with respect to each other at an approximately right angle, or less. The forward arm 22 is so arranged that its front portion overlaps, or falls below the latch 19 of the needle when the latch is extended backwardly, that is, when the latch is extended backwardly, that is, when the latch is open. As seen in view *a* of FIG. 5, the forward arm 22 overlaps the shank 18 of the needle, but is beneath the open latch 19. The other arm 21 is so arranged that in this position of the auxiliary latch 20, it projects outwardly, at an approximate right angle, or tipped slightly forwardly, as seen in FIG. 5. A leaf spring 23 is secured to the shank 18. Leaf spring 23 has a length to just engage the arm 21 of auxiliary latch 20 to hold the latch 20 in either of two positions shown, as illustrated in views *a* and *b* of FIG. 5, as will be discussed in detail.

Figure 6:
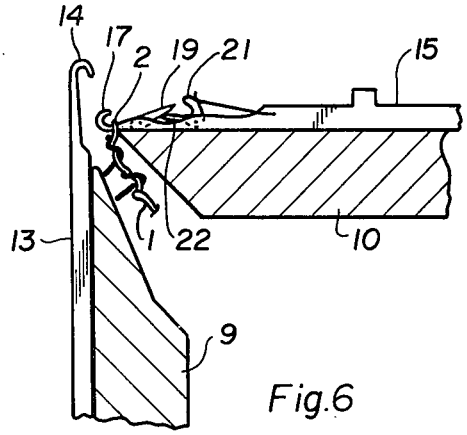
Figure 9:
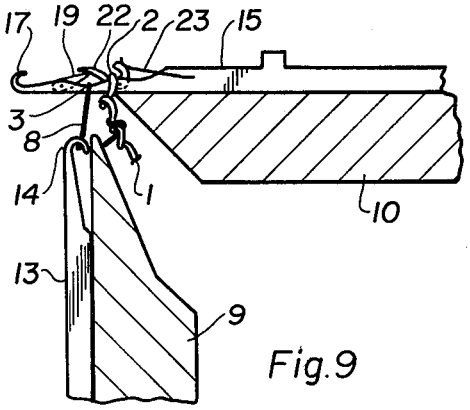
Figure 7:
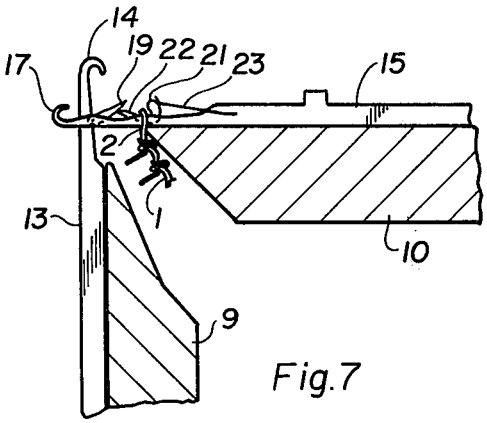
Figure 10:
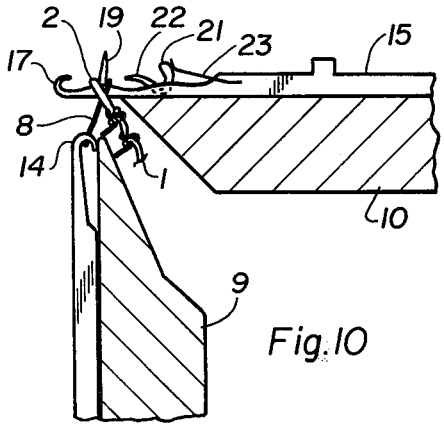

Manufacture of the fabric of FIG. 1, and operation of the machine, with reference to FIGS. 2, 5 and 6 to 11:

The auxiliary latch 20 cooperates with the latch tongue 19 of the needle 15 to form the knot-like connection of the inlay plush yarn 3 with the stitches 2 of the base fabric. Initially, in the position of the elements shown in FIG. 6, illustrated by the needle VI in FIG. 2, a stitch 2 of the base yarn 1 is caught in the hook 17 of the retracted needle 15. As the needle 15 is projected, the loop of the stitch 2 of the base thread, hanging in the hook 17, slips over the open latch 19 and over the underlying arm 22 of the auxiliary latch 20 until it catches in the angle between the two arms (21, 22) of the auxiliary latch 20 without, however, tipping the auxiliary latch. This is illustrated in FIG. 7, and FIG. 5 view *a*, and shown at needle VII of FIG. 2.

Figure 8:
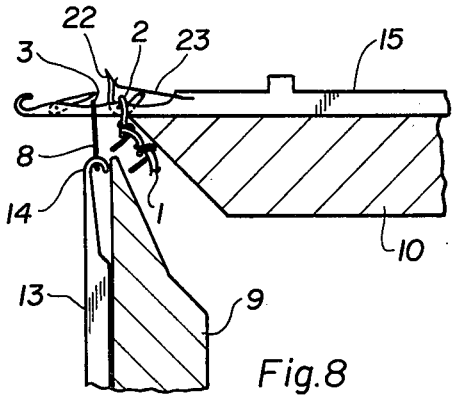
Figure 11:
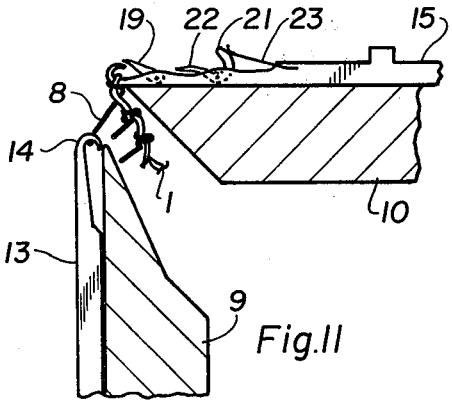
Figure 12:
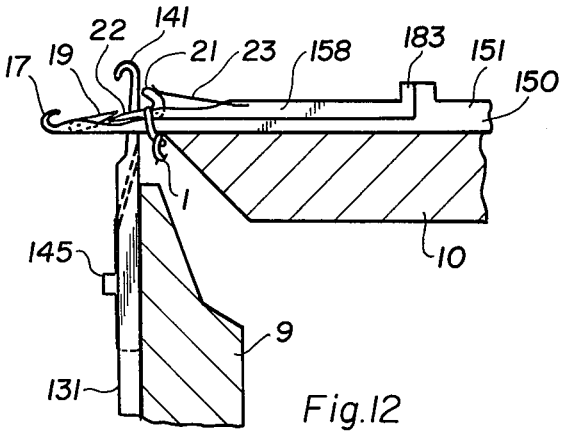
Figure 15:
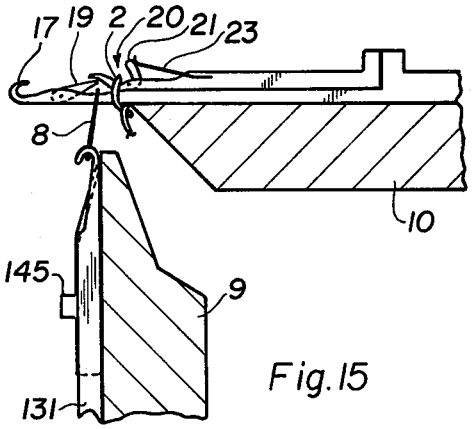
Figure 13:
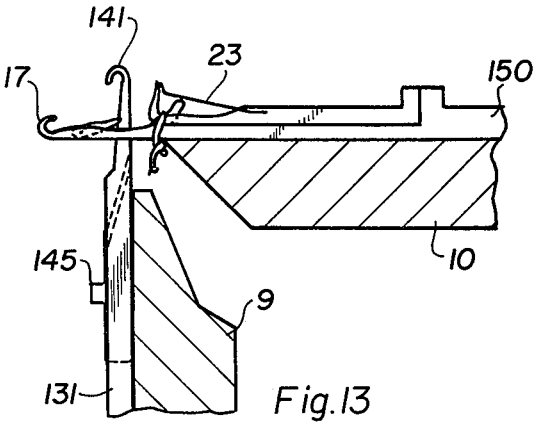
Figure 16:
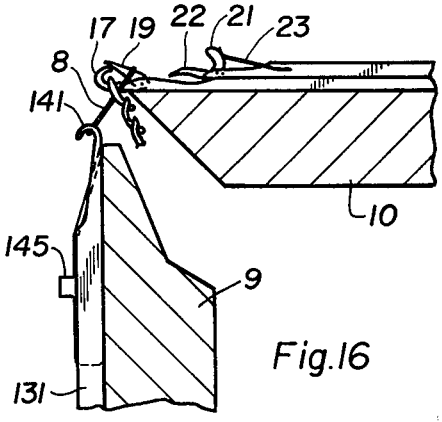
Figure 14:
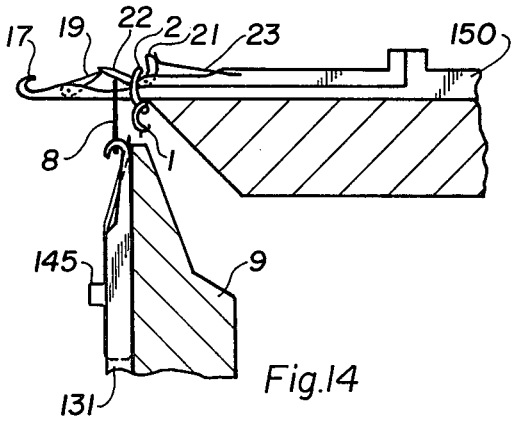

Further projections of the needle 15 causes tipping of the auxiliary latch 20 due to the pull of the loop 2 of the base yarn 1, so that the arm 22 will flip upwardly — see needle VIII, FIG. 2, FIG. 5 view 5*b*, and FIG. 8. The auxiliary latch 20 is locked in this position by spring 23 and the loop 2 of the base yarn 1 is positively positioned on the shank of the needle 15.

A yarn guide 24 now places the inlay plush yarn 3 behind the open latch 19 on the back of the shank of the needle 15. The sinker lamellae 13 catch the inley yarn with their hooks and pull it downwardly, as sequentially illustrated with respect to needles VIII and VIII*a*, FIG. 2 and as also seen in FIG. 5, view *b* and FIG. 8.

Needle 15, with the base yarn loop 2 at the back and the inlay yarn in front is now retracted. The arm 22 of the auxiliary latch 20 will now lay over the open latch 19 of the needle, so that the inlay plush yarn 3 will be locked beneath the arm 21 of the auxiliary latch 20 — see needle IX of FIG. 2, FIG. 5, view *c* and FIG. 9.

Further retraction movement of needle 15 causes the loop 2 of the base yarn to slip over the narrow arm 22 of auxiliary latch 20 back into the hook 17 of the needle. This causes the loop of the plush inlay yarn which is located on the back of the needle to be pulled through the loop 2 — see FIG. 2, needles X and X*a*, FIG. 5, view *d* and FIG. 10. This movement causes the plush inlay yarn to be located behind the open needle latch, as clearly seen in FIG. 5, view *d* and FIG. 10, so that further retraction of the needle 15 causes the latch 19 to close the hook 17 of the needle — see FIG. 2 needle X*a*, FIG. 5, view *d*, and FIG. 10.

Further retraction of the needle 15 causes the plush inlay yarn 3 to be knocked off over the latch 19 (which is closed) over the hook 17, that is, over the end thereof. The inlay yarn 3 thus is looped around the lateral portions 5, 6 of the base yarn stitch 2 in the form of a knot; the base yarn stitch 2 still hangs in the hook 17 of the needle. Thus, an inlay stitch, or inlay loop is securely interknitted with the base loop 2 — see FIG. 2, needle X*a*, and needle XI, FIG. 5, view *e* and FIG. 11.

The sinker lamellae 8, pull the lateral portions 8 of the stitch of the inlay or plaiting yarn and hold the inlay or plaiting yarn stretched over the back of the needle.

The inlay or plaiting yarn is held in this stretched position until the loop or stitch formed by the inlay or plaiting yarn, which might be termed the pile knot or pile stitch is securely interlocked in the base stitch 2 of the knitted base fabric as is clearly apparent by the position of the sinkers 13, considered in the sequential views FIGS. 8 through 11.

The inlay or plaiting yarn 3, now formed in loops is released from the hooks 14 of the sinker lamellae automatically by the fabric roll-up mechanism upon forming new courses of the base thread 1 and upon subsequent raising of the sinker lamellae 13, since the hooks 14 of sinker lamellae 13 face inwardly, that is, face the needles 15 on which the plush yarn is being knitted.

At a subsequent feed, the needle 15 is projected only to a lesser degree, that is, upon normal projection the needles 15 can knit in stitches similar to ordinary well known latch needles. The base yarn 1 is supplied by the customary usual yarn guides (not shown) to form ordinary jersey fabric. The loops of the plush fabric are then interknitted in the thus formed loops 2 at the next feed, as previously described.

FIG. 5, in views *a* to *e*, as well as FIG. 6 to 11 illustrate needles 15 which are unitary, that is, have a single-element needle shank or blade 18. Needles for use with machines having a coarse cut, and particularly to form fabric having heavy pile threads, needles 15 can be constructed as dual-needle elements as seen in FIGS. 3 and 4, in which corresponding parts have been given corresponding reference numerals.

Needle 150 has a lower, or base part 151 which is constructed as a standard latch needle. It has a narrow, low shank 180. The back of the shank 180 of the first or needle part 151 has a second part 152 arranged thereon, which is formed of a narrow shaft 182, the front end of which carries the pivotally secured auxiliary latch 20 having the two arms 21, 22. Leaf spring 23 is secured in shaft 182, for example, by forming a narrow slit in the shaft, and crimping the leaf spring therein, or securing it by an interference fit. The operation of the composite compound needle formed of parts 151, 152 is similar to that of the unitary needle. The two parts 151, 152 are formed with respective butts 153, 183, located one behind the other (see FIG. 3, 4) and engagable together in a common cam race of the cam track or cam lock, so that both parts 151, 152 are commonly controlled.

If the plush is to be cut pile fabric, then it is necessary to cut open the lateral portions of the plush or pile loops. To effect cutting during the manufacturing operation of the fabric, the single-element sinkers 13 are replaced by multiple elements, best seen in FIGS. 18 and 19. Each one of the sinker lamellae consists of individual, congruent, thin sheet metal elements 131, shaped similar to the lamella 13 and formed with respective end hooks 141. A thin cutter lamella 143 is located between the two sheet metal lamella elements 131. Movement of the lamella elements 131 is controlled by engagement of respective butts 142 in an appropriate cam track, or cam race of the cam lock of the cylinder of the machine. The cutter lamella 143 is sharpened at the end to form a cutting edge 144, preferably a razor sharp ground edge. Movement of the cutter lamella 143 is controlled by an individual butt 145, engaging its own cam race or cam track of the cylinder cam system.

Operation: Upon upward movement of the cutter lamella 143 between the two lamella elements 131 in the direction of the end hook 141, a pile or plush loop hooked into the hooks 141 will be cut, as seen in FIG. 17. Relative movement of the cutter lamella 143 and of the sinker lamellae elements 131 is independent.

The hooks 141 of the sinker lamellae 131 extend outwardly (FIG. 20) the hook 141, could, of course, also extend inwardly; this only requires relocation of the butts 142. Outward positioning of the hooks 141 will not cause catching of the inlay yarn since the loops thereof are being cut.

Manufacture of cut-pile or nap plush fabric, with reference to FIGS. 12 to 17:

Basically, the sequence of steps is similar to those discussed in connection with FIGS. 6 to 11. The steps of FIGS. 12 to 16 correspond exactly to the steps previously discussed in connection with FIGS. 7 to 10. In contrast to the knock over operation discussed in connection with FIG. 11, however, the cutter lamella 143 is projected (FIG. 17) so that the loop which hangs on the sinker lamellae 131 is cut at the lateral portion between the interknitted, or "interknotted" loops. Thus, the lateral portions 8 are cut, permitting subsequent retraction of the lamellae, as well as of the needle; the needle 15 then will pass to the next feed, where, as previously discussed, another course of base yarn stitches will be formed.

The needle itself, and its cooperation with the two yarns — base yarn 1 and inlay plush yarn 3 — is best seen with reference to FIGS. 21 – 26.

It has previously been proposed (see, for example, German Pat. Nos. 572,374 and 627,711) to construct latch needles with two sequentially arranged latches. To form interlocked stitches of two yarns such needles require an extension, or projection of such a needle which is excessively long, and causes difficulty in machine construction and machine operation. The second needle latch, in the known constructions, is controlled solely by the loop, or stitch sliding thereover. Changes in position of the loop or stitch beyond those desired or contemplated may cause positioning of the respective latches in undesired relative arrangements, thus causing defective fabric. It was difficult to provide arrangements to protect the latches of the needles against erroneous positions, and to reposition the latches; thus, such needles have not found commercial acceptance.

The needle of FIGS. 21 to 26 basically is similar to an ordinary circular knitting machine latch needle, as well known in the art, having a shank with a control butt 253 (shown only in FIGS. 21 and 24, for simplicity), and at the forward end a hook 207, which can be opened or closed by a latch 208. The needle is formed with a groove in which the latch 208 is pivoted. In accordance with the present invention, the groove is extended, or a similar groove is formed rearwardly of the groove in which the latch 208 is secured to permit placement of an auxiliary latch 209. Latch 209 has two arms, and is pivoted at pivot 291 to the shank of the needle. The latch 209 — see FIG. 26 — is angled, and is so inserted in the groove cut into the shank of the needle that the narrower arm fits with the tip thereof under the tip of the latch 208, when open, as best seen in FIG. 21.

The distance between the pivot point 91 for auxiliary latch 9 and the pivot point of latch 208 is so matched to the length of the latch 208 that the tip of the auxiliary latch 209 and the tip of the latch 208 are mutually overlapping, either one above the other, as seen in FIGS. 21 and 23 respectively. The auxiliary latch 9 is as freely moveable in its groove and about its pivot as the latch 208.

A leaf spring 210, secured to the shank of the needle, for example, by an interference fit in a slit formed in the shank, by being crimped therein or in similar manner has a free end which extends to about the position of the pivot 291. Leaf spring 210 prevents random flipping of the auxiliary latch 209. The leaf spring is weak, and provides slight pressure on the rearward arm of auxiliary latch 209.

Operation to form interlocked loops:

The auxiliary latch 209 is tipped or pivoted by a stitch 211 already on the needle. This stitch 211 is formed during projection of the needle and after sliding over the open latch 208 covering the forward arm of auxiliary latch 209 (FIG. 21). As the needle continues to project, the stitch 211 slides further up on the needle until it catches in the hollow formed between the arms of the auxiliary latch and is practically above the pivot point 91 of the auxiliary latch. Further projection, and rearward sliding of the stitch 211 causes tipping over of the auxiliary latch 209 into the position shown in FIG. 22. The tipping angle is about 80°.

In the position of FIG. 22, leaf spring 210 covers the shorter arm of the auxiliary latch. The forward end of the leaf spring 210 engages the longer arm of the auxiliary latch 209, thus securing the position of the auxiliary latch 209. Spring 210, thus, holds the latch 209 in position to permit an inlay yarn 210 to be inserted to form an interknitted, or interknotted fabric formation. Introduction of a further loop of material 212 is also shown in FIG. 22, which illustrates the loop of the inlay or plaiting yarn 212 already in position after having slid back over the open latch 208.

The needle is then projected forwardly. This causes yarn 211 to pull forwardly, and flip the auxiliary latch 209 into the position shown in FIG. 23. The longer arm of latch 209 now overlaps the tip of the latch 208. The inlay or plaiting yarn 212 is now beneath the auxiliary latch 209, whereas the original, or base yarn 211 is above the latch 209, and hence above the latch 208. Leaf spring 210 again engages the back of the shorter arm of the auxiliary latch 209 to hold it securely in position and to lock the inlay or plaiting yarn 212 beneath the overlapping tips of the latches 208, 209. The position of the latches in FIG. 23 is, therefore, reliably maintained.

Retraction of the needle then causes the loop 211 to slide over the inner portion of the latch 208 and to catch in the hook 207. This motion effects looping the yarn 212 through the loop formed by the yarn 211. The yarn 212 is pulled downwardly by sinkers. Upon further retraction of the needle beyond the position shown in FIG. 23, the yarn 212 will slide against the bottom of the tongue of the open latch 208, causing slight lifting of the auxiliary latch 209 and release of the latch 208, to permit the loop of the inlay or plaiting yarn 212 to be knocked off over the closed end of the needle (latch 208 having closed over the hook 207), thus forming interknotted stitches which are wrapped around each other.

Sliding motion of the inlay or plaiting yarn 212 causes only slight raising of the tip of the latch 208, and hence slight raising of the longer arm of the auxiliary latch 209. This does not materially pivot the auxiliary latch 209. As soon as the tip of the latch 208 has slipped over the tip of the longer arm of latch 209, spring 210 will press the latch 209 completely downwardly into the position shown in FIG. 21. Latch 208, however, will be closed over the hook 207.

The sequence can then repeat.

The needle, and the machine are versatile, since ordinary knit goods can be made without needle change. If no inlay or plaiting yarn is being used, knitting in accordance with ordinary knitting stitches and sequences can be carried out; the position of the auxiliary latch will merely be that shown in FIG. 21, and the latch will remain in this position. The projection, or extension of the needle from non-knitting to knitting position need not be as great, however, as the projection when working with inlay or plaiting yarn.

The needle can be used with all types of knitting machines, but is particularly useful in circular knitting machines to manufacture knit goods with inlay or plaiting yarns, such as napped, or pile fabric. The reliable and automatic positioning of the auxiliary latch 209 by the spring 210 permits operation of the needle in any type of needle bed, in the cylinder as well as in the dial, permitting reliable and rapid, high speed operation. Even inadvertant change of position of an auxiliary latch element 209 will not affect ordinary plain or Jersey knitting since loops or stitches applied to the needle will, during knitting operation, automatically cause repositioning of the auxiliary latch as desired.

The needle can be used with practically any commercial cut, and for all types of fabrics, for example to make no-run hosiery, as well as for the manufacture of plush type fabric, with inlay or plaiting yarns, that is, with auxiliary pile or nap yarn, in which the inlay or plaiting yarn is securely knotted into a base fabric. The needle has the substantial advantage that it can operate with comparatively short projection, or extension paths, while reliably interknotting, and interknitting inlay or plaiting yarns into a base fabric, and insuring proper positioning of the auxiliary latch due to the spring bias. If a change in fabric is desired, no needle change in the machine is required, thus eliminating the laborious exchange of needle, which is particularly time consuming in multi-feed fine cut machines. It is only necessary to arrange the cam races for the proper projection for needle operation. The needle can also be used in automatically patterned machines, in which inlay or plaiting yarn is selectively introduced at some needles, but not all, and the particular needles carrying inlay or plaiting yarn vary at different feeds.

Various changes and modifications may be made and features described in connection with any one of the embodiments may be used with any of the others, within the scope of the invention concept.

I claim:

1. Method to knit plush fabric on a knitting machine having a row of needles, in which the fabric has base knitted fabric in which base yarn (1) is knitted to form knit stitches or loops (2) and an inlay or plaiting plush yarn (3) having loop and side portions, interknitted with and anchored to the base fabric comprising the steps of knitting a course of stitches (2) of the base fabric on the needles (15) of the row with at least one base yarn thread (1);

pushing the loops (2) of the knitted stitches up on the shanks of the needles (15);

positively positioning the loops (2) of the stitches of the base yarn thread (1) at a predetermined position on the shanks of the needles;

pulling the inlay or plaiting yarn over the needle shanks to form plush inlay loops (4) having side portions (8);

engaging, and pulling the inlay or plaiting yarn (3) in a direction essentially perpendicular to the direction of movement of the needle, and holding the inlay or plaiting yarn in engaged, pulled position;

pulling the plush inlay or plaiting loops (4) through the loops (2) of the stitches of the knitted base yarn (1) while continuing to hold and engage the inlay or plaiting yarn;

sliding the loops (2) of the stitches of the base yarn (1) over the shank of the needle (15) towards the hook thereof while continuing to hold and engage the inlay or plaiting yarns (13) in said pulled position;

knocking off the loops (4) of the inlay or plaiting yarn (3) over the end of the needles while continuing to hold and engage the inlay or plaiting yarn in said pulled position;

and pulling tight the thus formed loops of the held and engaged inlay or plaiting yarn, to lock and thereby wrap the loop (4) of the inlay or plaiting yarn (3) around the side portions (5, 6) of the knit loops, or stitches of the base yarn (1).

2. Method according to claim 1, wherein the step of sliding the loops (2) of the stitches of the base yarn (1) over the shank of the needle towards the hook comprises catching the loops (2) in the hooks (17) of the needles (15).

3. Method according to claim 2, further comprising the step of covering the exposed hook (17) of the needle (15) after said sliding and catching steps with a cover element 19 to permit free sliding of the inlay or plaiting yarn loops (4) before and upon knock-off and the pulling steps.

* * * * *